US006325139B1

(12) United States Patent
Maruyama

(10) Patent No.: US 6,325,139 B1
(45) Date of Patent: Dec. 4, 2001

(54) HEAT-EXCHANGE COIL ASSEMBLY

(76) Inventor: Noboru Maruyama, 2-26-14 Shirasagi, Nakano-ku, Tokyo (JP)

( * ) Notice: Subject to any disclaimer, the term of this patent is extended or adjusted under 35 U.S.C. 154(b) by 0 days.

(21) Appl. No.: 09/310,892

(22) Filed: May 12, 1999

(30) Foreign Application Priority Data

May 15, 1998 (JP) ..... 10-132923

(51) Int. Cl.[7] ..... F28F 9/22; F28D 7/02

(52) U.S. Cl. ..... 165/145; 165/163; 165/175; 165/176

(58) Field of Search ..... 165/163, 176, 165/175, 145, 144

(56) References Cited

U.S. PATENT DOCUMENTS 1,684,083 * 9/1928 Bloom ..... 165/175 X
3,757,746 * 9/1973 Sharan ..... 165/145 X
4,182,413 * 1/1980 Kissinger ..... 165/163
4,256,176 * 3/1981 Cohen ..... 165/163 X
4,893,672 * 1/1990 Bader ..... 165/163
5,109,920 * 5/1992 Merryfull ..... 165/163
5,579,836 * 12/1996 Maruyama ..... 165/175

FOREIGN PATENT DOCUMENTS

615889 * 7/1935 (DE) ..... 165/175
621822 * 5/1927 (FR) ..... 165/163

* cited by examiner

*Primary Examiner*—Leonard Leo
(74) *Attorney, Agent, or Firm*—Kuffner & Associates

(57) ABSTRACT

The present invention provides a heat-exchange coil assembly making it possible to enlarge a heat conduction area within a limited volume by lowering the pitch between heat-exchange coils to a minimum level without providing a welding space. The heat-exchange coil assembly comprises an inlet header 2 at an end section thereof, an inlet tube 3 for inletting a heat exchange medium provided in a drum, an outlet header 4 located with a space from the inlet header at an end section thereof, and a plurality of heat-exchange coils with the outlet tube 5 for outletting a heat-exchange medium from the drum, inlet header 2, and outlet header 4 communicated to each other and also having a common center line, in which the heat-exchange coils are alternately linked to both sides of the inlet header 2 and outlet header 4.

12 Claims, 17 Drawing Sheets

HEAT-EXCHANGE COIL ASSEMBLY

BACKGROUND OF THE INVENTION

The present invention relates to a heat-exchange coil assembly, and more particularly to a heat-exchange coil assembly accommodated in a drum for exchanging heat between a heat-exchange medium flowing in the drum and a heat-exchange medium flowing in the coil.

The inventor for the present invention has already proposed, as disclosed in Japanese Patent Laid-Open Publication No. 8-54192, a heat-exchange coil assembly in which a plurality of heat-exchange coils each having a different winding diameter are arranged so that they have a common center line. With this heat-exchange coil assembly, there are provided the advantages that the heat exchange efficiency can be improved without making larger a drum capacity of the heat exchanger, and that the heat exchange capability can freely be set.

In this type of heat-exchange coil assembly as shown in FIG. 1, the ends 6-1, 2, 3, 4, and 5 of the heat-exchange coils are linked to an inlet header 2 and the ends 7-1, 2, 3, 4, and 5 to an outlet header 4 at their center lines B—B and B'—B', respectively. As shown in FIG. 27, the linkage is achieved by welding the heat-exchange coils 28-1, 2, 3, 4, and 5 to the same side of the inlet header and outlet header. Because of this configuration, a pitch P' between any adjoining two of the heat-exchange coils 28-1, 2, 3, 4, and 5 must be set to at least a value obtained by adding a width equal to 2*a*, where a equals the width of the weld to the external diameter d of the heat-exchange coil tubes, as shown on FIG. 3. This required configuration disadvantageously makes it difficult to realize a small-sized and compact heat-exchange coil assembly.

OBJECT AND SUMMARY OF THE INVENTION

The present invention was made to solve the problems associated with the conventional type of heat-exchange coil assembly based on the conventional technology as described above, and it is an object of the present invention to provide a heat-exchange coil assembly which prevents the pitch between adjoining heat-exchange coil pipes from becoming larger due to a welding space for linking an inlet header and an outlet header to the heat-exchange coil. This heat-exchange coil assembly can be installed within a limited space because of this construction, providing a large heat conducting area.

To achieve the object as described above, the present invention provides a heat-exchange assembly coil comprising a medium inlet member having a heat-exchange medium inlet tube and an inlet header, a medium outlet member having a heat-exchange medium outlet tube and an outlet header, and a plurality of heat-exchange coils, each communicating between the inlet header and the outlet header and having a different diameter, and the heat-exchange coil can be installed within a drum and, in one embodiment, is characterized in that each of the heat-exchange coils is linked to the inlet headers and outlet headers alternately located on opposite sides of the common center line of the heat-exchange coils.

In a second embodiment, the present invention is characterized in that the inlet headers and outlet headers are located on the same of the common center line of the heat-exchange coils.

The present invention is characterized in that a plurality of inlet headers and a plurality of outlet headers are linked to one inlet tube and one outlet tube respectively and the inlet headers and outlet headers are linked to each other with a heat-exchange coil respectively.

The present invention is characterized in that the inlet tube and outlet tube comprises first and second inlet tubes and first and second outlet tubes respectively, tips of the inlet headers of the first and second inlet headers are not-commnunicably jointed to each other, tips of the outlet headers of the first and second outlet tubes are not-communicably jointed to each other, and also that heat-exchange coil groups are arranged between the inlet header tube of the first inlet header and the outlet header tube of the first outlet header and between the inlet header of the second inlet tube and the outlet header of the second outlet tube respectively.

The present invention is characterized in that a group of heat-exchange coils corresponding to the first inlet tube and first outlet tube and a group of heat-exchange coils corresponding to the second inlet tube and second outlet tube are different from each other in terms of the coil length and coil diameter.

The present invention is characterized in that the heat-exchange coils are linked to the first and second inlet headers alternately, and are also linked to the first and second outlet headers alternately.

The present invention is characterized in that tips of the first and second inlet headers of the first inlet tube are not-communicably jointed to the first and second inlet headers of the second inlet tube, tips of the first and second outlet headers of the first outlet tube are not- communicably linked to tips of the first and second outlet headers of the second outlet tube, and also that heat exchange coil groups are arranged between the first and second inlet headers of the first inlet tube and first and second outlet headers of the first outlet tube and between the first and second inlet headers of the second inlet tube and the first and second outlet headers of the second outlet tube respectively.

The present invention is characterized in that a group of heat-exchange coils corresponding to the first inlet tube and first outlet tube and a group of heat-exchange coils corresponding to the second inlet tube and second outlet tube are different from each other in terms of the coil length and coil diameter.

The present invention is characterized in that, in a heat-exchange coil assembly installed in a drum and comprising a medium inlet member having an inlet tube and an inlet header each for inletting a heat-exchange medium, a medium outlet member having an outlet tube and an outlet header each for outletting a heat-exchange medium, and a plurality of heat-exchange coils each communicating the inlet header to the outlet header and having a different winding diameter, the medium inlet member and medium outlet member are adjoining and located at positions close to each other.

The present invention is characterized in that the inlet header and outlet header are located in a single tube and formed with chambers separated from each other with a partition.

The present invention is characterized in that the heat-exchange coils have the same length.

DETAILED DESCRIPTION OF THE EMBODIMENTS

Figure 1:
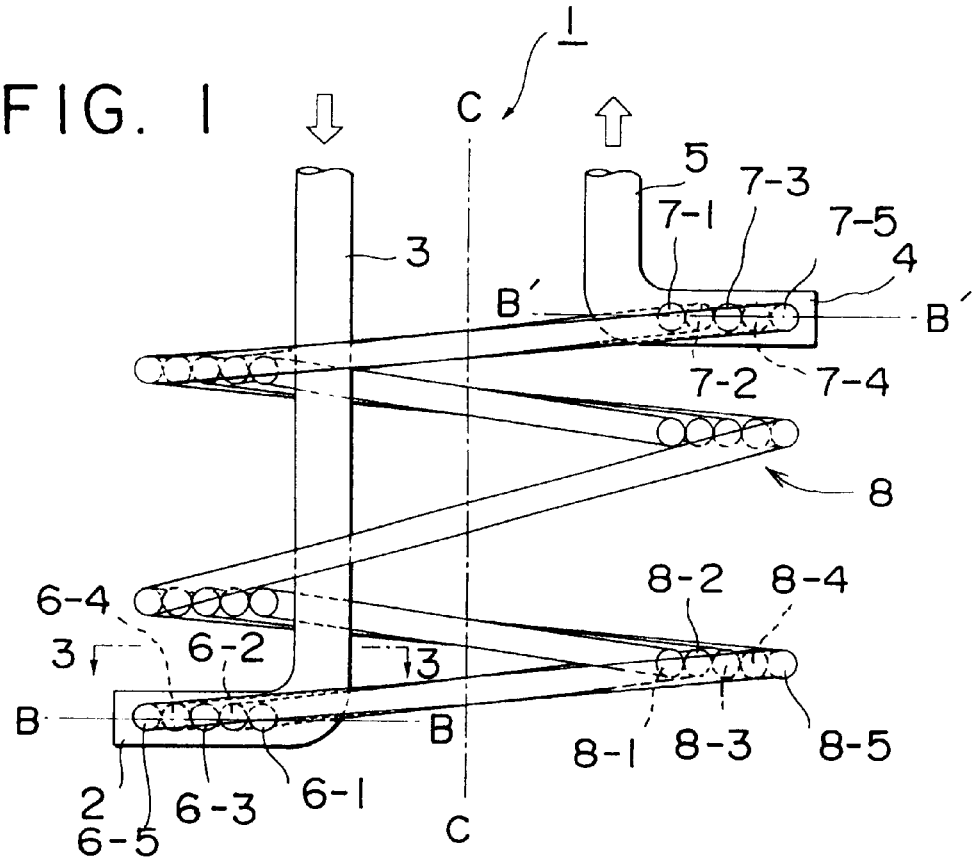
FIG. 1 is a front view showing a first embodiment of the present invention.
Figure 2:
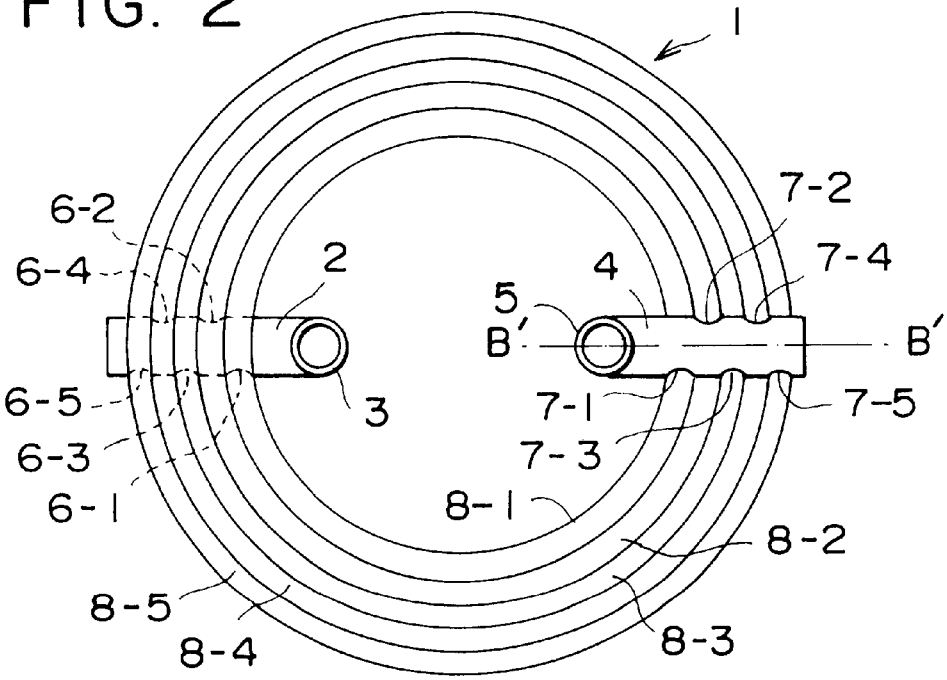
FIG. 2 is a plan view showing the same.

Description is made hereinafter for embodiments of the present invention with reference to the related drawings. In a first embodiment of the present invention shown in FIGS. 1 to 3, the reference numeral 1 indicates a heat-exchange coil assembly 1, and in this heat-exchange coil assembly 1, an inlet 2 is provided at a lower edge of an inlet tube 3 in a posture substantially perpendicular thereto and an outlet header 4 is provided at a lower edge of an outlet tube 5 in a posture substantially perpendicular thereto.

The inlet tube 3 and outlet tube 5 are located in parallel to each other, and the inlet header 2 and outlet header 4 are located with a space therebetween in the center line C—C of the inlet tube 3 as well as of the outlet tube 5. A plurality of inlet ports 6-1, 3, 5 and 6-2, 4 (five holes in this embodiment) are provided on the peripheral wall of the inlet header 2 in both sides of the center line thereof with a specified pitch. The inlet ports 6-1, 3, 5 each having an odd number, are located in one side of the center line B—B of the inlet header 2, and the inlet ports 6-2, 4 each having an even number are located in the other side of the center line B—B. Similarly, outlet ports 7-1, 3,5 are located in one side of the center line B'—B' of the outlet header 4 and outlet ports 7-2, 4 are located in the other side of the center line B'—B'.

A heat-exchange coil group 8 comprising a plurality of heat-exchange coils 8-1, 2, 3, 4, 5 (five pieces in this embodiment) are located between the inlet header 2 and the outlet header 4. Each of the heat-exchange coils 8-1, 2, 3, 4, 5 has a different winding diameter and a common center line C—C, and is formed by winding a wire around a heat conduction pipe made from such a material as a copper tube, a steel tube, a specific steel tube or the like in the conventional technology.

Of the heat-exchange coils constituting the group 8, both ends of each of the heat-exchange coils 8-1, 3, 5 having an odd number respectively are linked to the inlet ports 6-1, 3, 5, each having an odd number, of the inlet header 2 as well as to the ports 7-1, 3, 5, each having an odd number, in the outlet header 4 respectively. Both ends of heat-exchange coils 8- 2, 4 each having an even number are linked to the inlet ports 6-2, 4 each having an even number, in the inlet header 2 as well as to the outlet ports 7-2, 4 each having an even number, in the outlet header 4 respectively. As described above, both ends of each of the heat-exchange coils 8-1, 3, 5 and 8-2, 4 are alternately linked to both sides of a center line B—B of the inlet header 2 as well as of the outlet header 4, and because of this configuration, a fluid flowing out from the inlet header 2 through the heat-exchange coils 8-1, 3, 5 and 8-2, 4 flows in a direction opposite to a flowing direction of a fluid flowing into the outlet header 4.

Figure 25:
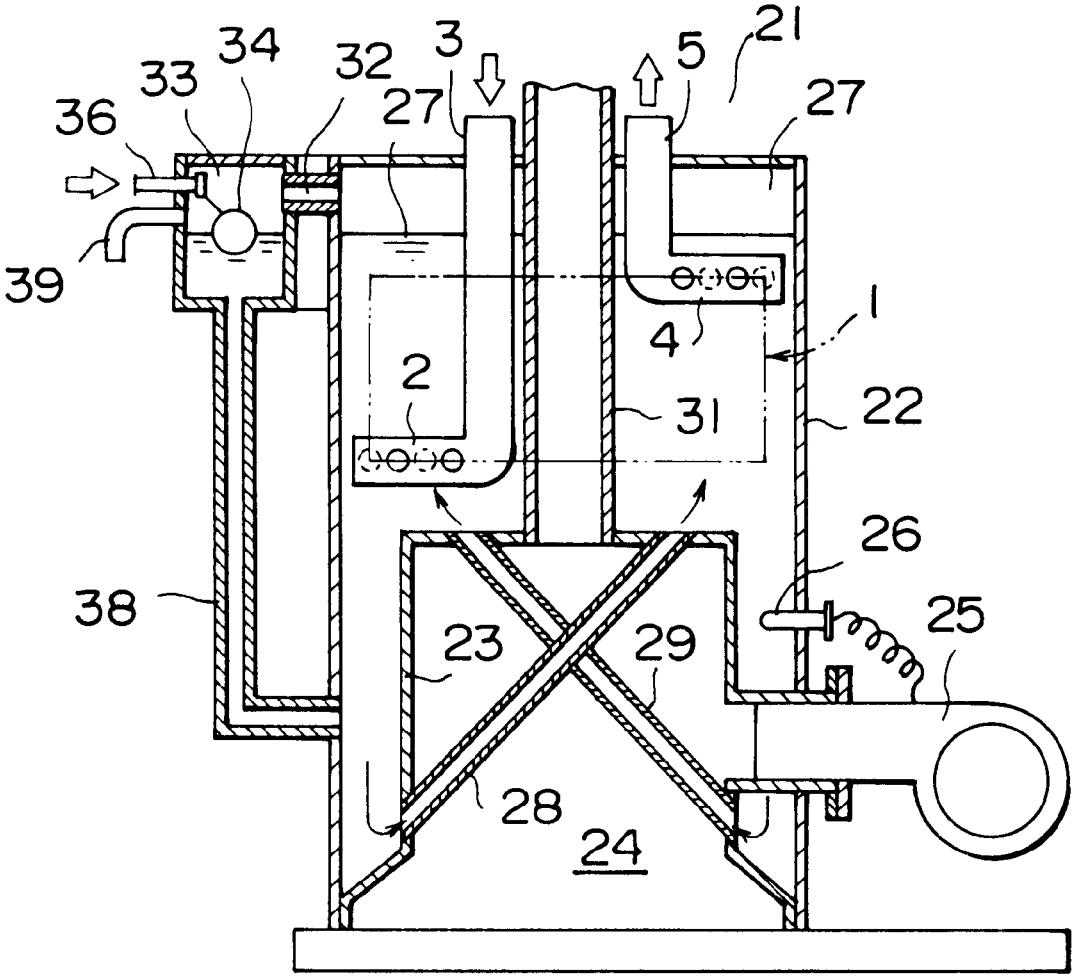
FIG. 25 is a vertical cross-sectional view showing a heat exchanger in which the heat-exchange coil assembly according to the present invention is applied.
Figure 26:
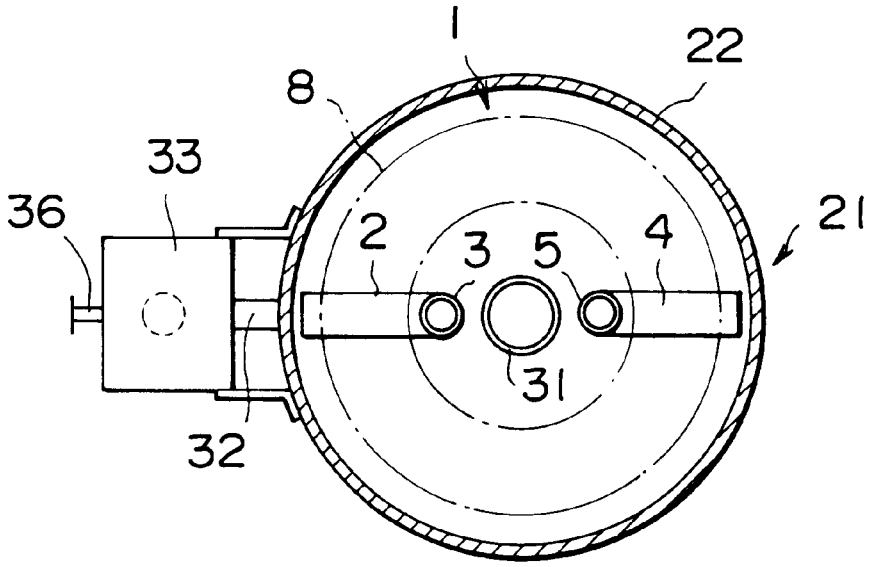
FIG. 26 is a lateral cross-sectional view showing the same.
Figure 27:
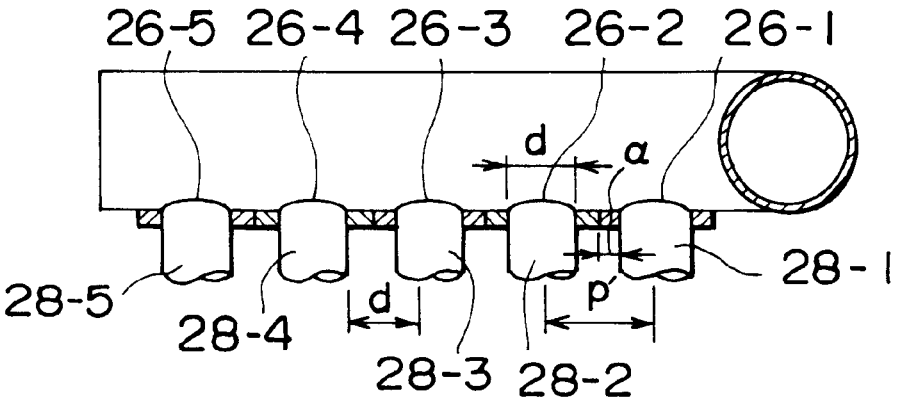
FIG. 27 is a partial plan view showing a linking section between a heat-exchange coil and an inlet tube and an outlet tube in a heat-exchange coil assembly similar to that according to the present invention but based on the conventional technology.

As shown in FIG. 25 and FIG. 26 and described below, the heat-exchange coil assembly 1 as described above is installed inside a drum section 22 in which a second heat-exchange medium 27 comprising a gas or a liquid for a heat exchanger 21 is accommodated. A first heat-exchange medium comprising a gas or a liquid for exchanging heat with the second heat-exchange medium 27 is introduced as a descending flow through the inlet tube 3 into a drum section 22. In this step, the first heat-exchange medium flows through the inlet ports 6-1, 2, 3, 4, 5 in the inlet header 2 into the heat-exchange coils 8-1, 2, 3, 4, and 5, and flows upward in a spiral form in these heat-exchange coils 8-1, 2, 3, 4, and 5.

The first heat-exchange medium exchanges heat with the second heat-exchange medium in the drum section 22 via a wall thereof when flowing in the heat-exchange coils 8-1, 2, 3, 4, and 5, and further flows via the outlet ports 7-1, 2, 3, 4 and 5 into the outlet header 4, and then is discharged through the outlet tube 5 from the drum 22 and sent to a load.

With the heat-exchange coil assembly 1 as described above, in the heat-exchange coils 8-1, 2, 3, 4, and 5 adjacent to each other in the winding section, of the inlet ports 6-1, 2, 3, 4, 5 and outlet ports 7-1, 2, 3, 4, 5, those having an odd number and those having an even number are located in opposite sides of the center line B—B and B'—B' of the inlet header 2 as well as of the outlet header 4, so that the heat-exchange coils 8-1, 2, 3, 4, and 5 adjoining to each other in this linking section are separated from each other.

Figure 3:
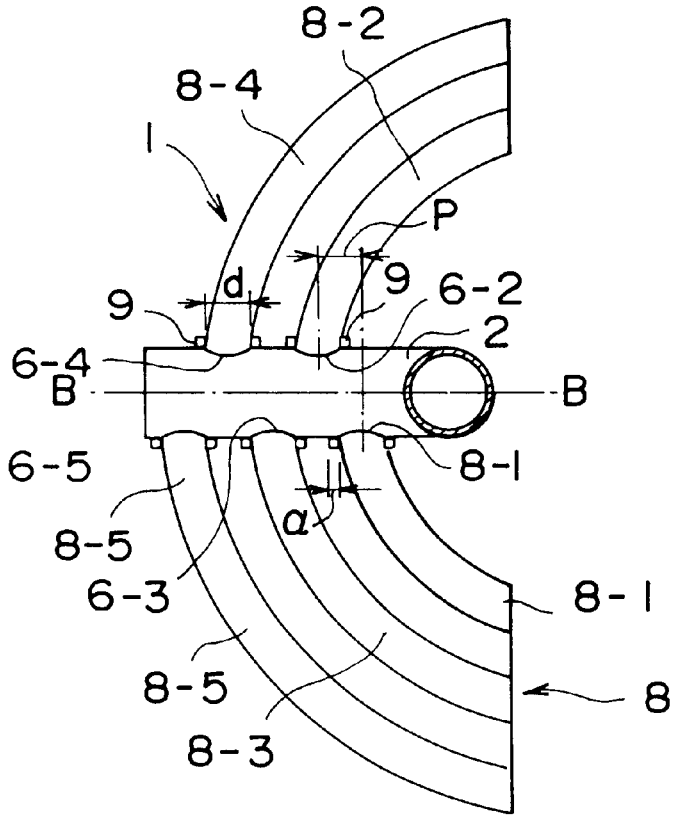
FIG. 3 is a sectional view along the line 3—3 in FIG. 1 and viewed from a direction indicated by the arrow.

Because of the configuration, as shown in FIG. 3, different from a heat-exchange coil assembly based on the conventional technology, an additional space for welding 2*a* is not required, and a pitch between adjoining two ones of the heat-exchange coils 8-1, 2, 3, 4, and 5 can be made equal to an outer diameter d of each of the heat-exchange coil tubes 8-1, 2, 3, 4, and 5. In this embodiment, there are five heat-exchange coils 8, but the configuration is not so limited, and the heat exchange efficiency can freely be set by selecting a number of heat-exchange coils according to requirements, which makes it possible for the heat-exchange coils to be applied in heat exchangers having various sizes from a small scale up to a large scale.

Figure 4:
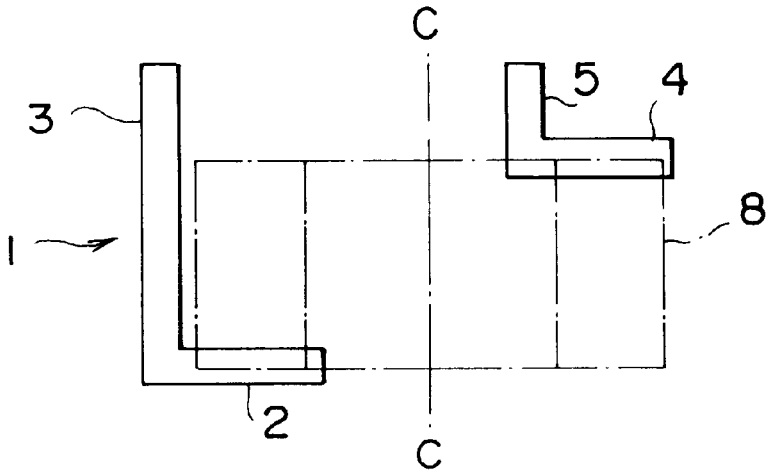
FIG. 4 is a general diagram showing a second embodiment of the present invention.
Figure 6:
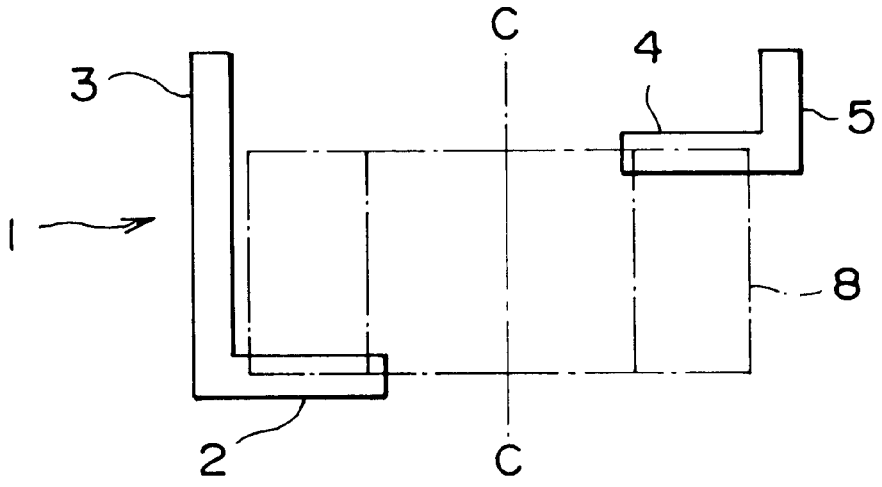
FIG. 6 is a general diagram showing a fourth embodiment of the present invention.

FIG. 4 and FIG. 6 show outlines of two embodiments of the present invention, and in each of these embodiments, the inlet tube 3 is located outside of the heat-exchange coil group 8 (in the outer side from a coil having the maximum winding diameter), and the outlet tube 5 is located inside the heat-exchange coil group 8 (in the inner side from a coil having the minimum winding diameter).

Figure 5:
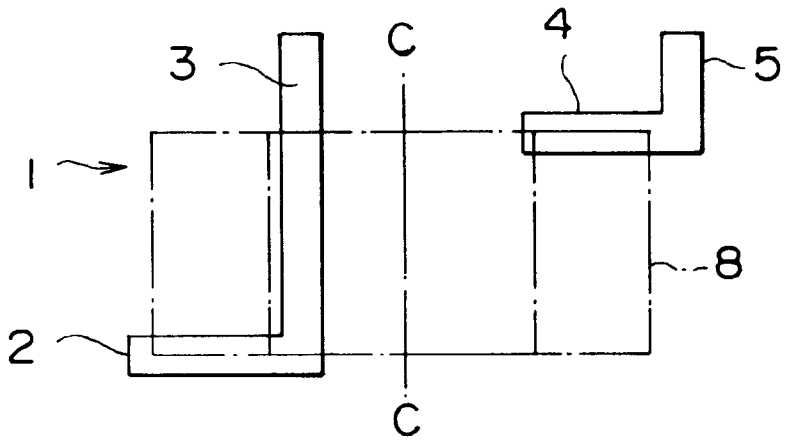
FIG. 5 is a general diagram showing a third embodiment of the present invention.

In a third embodiment shown in FIG. 5, the inlet tube 3 is located inside the heat-exchange coil group 8. In the fourth embodiment shown in FIG. 6, both the inlet tube 3 and outlet tube 5 are located outside the heat-exchange coil group 8. The inlet tube 3 and outlet tube 5 are located in various modes. These embodiments are different from the first embodiment only in the points described above, so that detailed description thereof is omitted herein.

Figure 7:
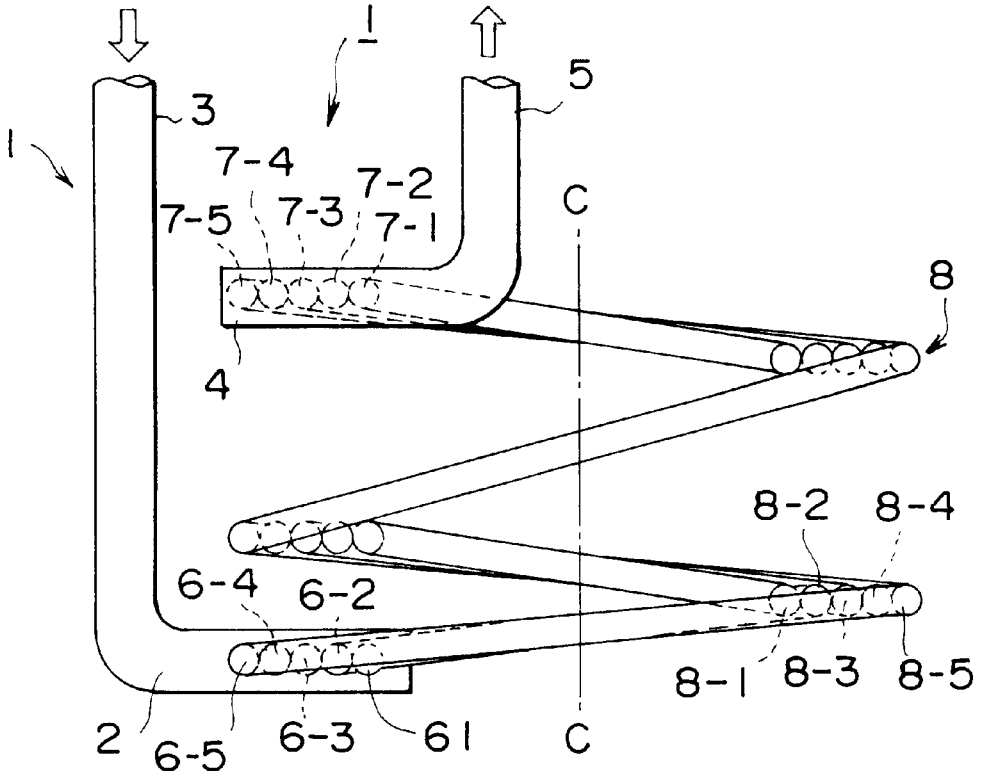
FIG. 7 is a front view showing a fifth embodiment of the present invention.
Figure 8:
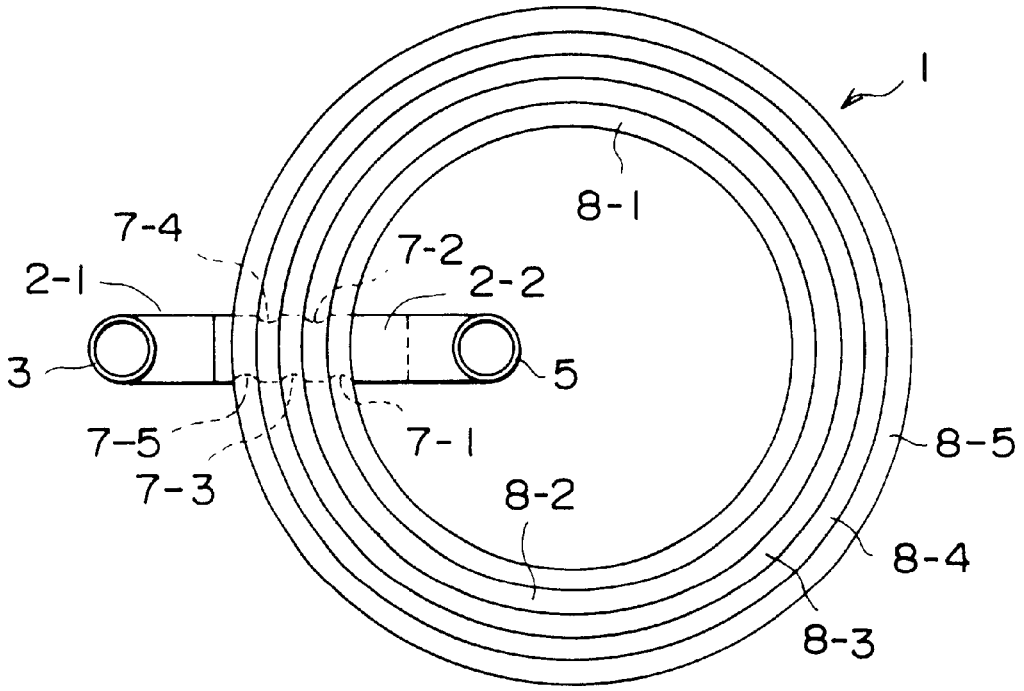
FIG. 8 is a plan view showing the same.

FIG. 7 and FIG. 8 show a fifth embodiment of the present invention, and this embodiment is different from the first to fourth embodiments in the point that both the inlet header 2 and outlet header 4 are located in one side of the center line C—C of the heat-exchange coil group 8. Because of the arrangement described above, a winding number in the heat-exchange coil group 8 is n (n: integral number).

A number of turns in a heat-exchange coil group in the first to fourth embodiments of the present invention is n+0.5, while that in the fifth embodiment is n, which saves material for the heat-exchange coil, and the fifth embodiment is different from the first to fourth embodiments also in this point, but is the same as the first to fourth embodiment in other points, so that detailed description thereof is omitted herein.

Figure 9:
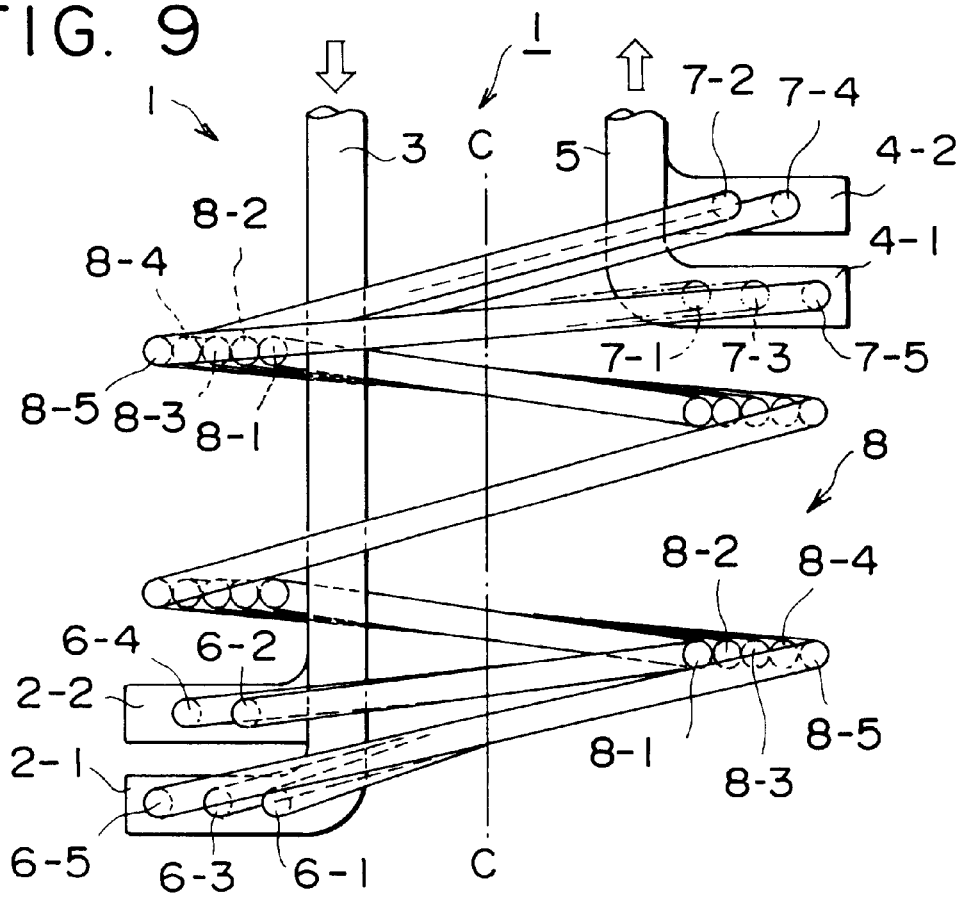
FIG. 9 is a front view showing a sixth embodiment of the present invention.
Figure 10:
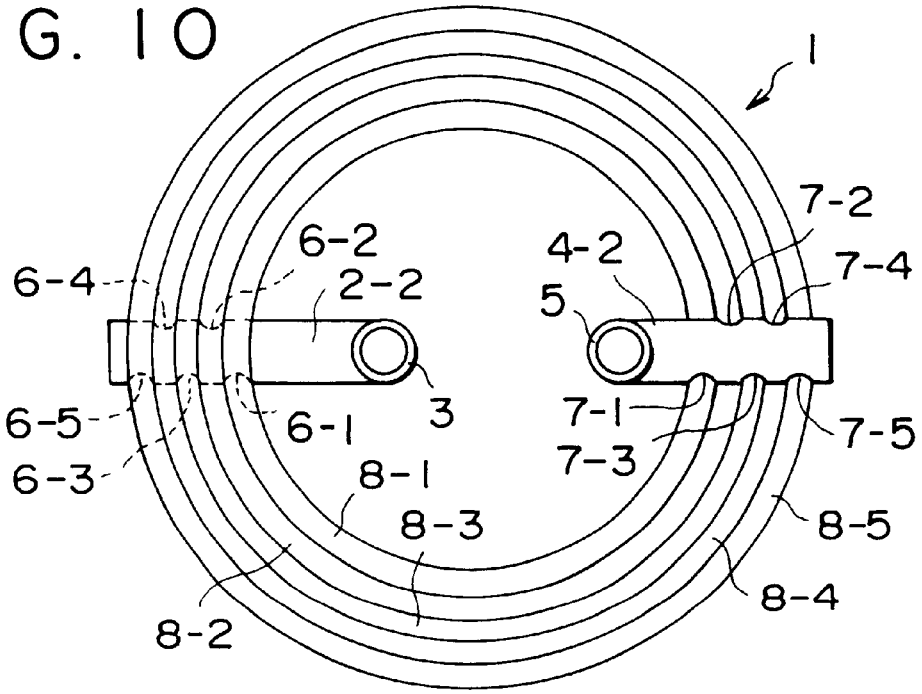
FIG. 10 is a plan view showing the same.

FIG. 9 and FIG. 10 each show a sixth embodiment of the present invention, and in this embodiment, first and second headers 2-1, 2 are provided in parallel to each other in the inlet tube 3, the inlet ports each having an odd number are provided in the first inlet header 2-1 and the inlet ports 6-2, 4 each having an even number are provided in the second inlet header 2-2. Similarly, first and second outlet headers 4-1, 2 are provided in parallel to each other in the outlet tube 5, and the outlet ports each having an odd number are provided in the first outlet header 4-1, while the outlet ports each having an even number are provided in the second outlet header 4-2.

Of the heat exchange coils 8-1, 2, 3, 4, and 5, the heat-exchange coils 8-1, 3, and 5 each having an odd number are linked to the outflow ports 6-1, 3, 5 each having an odd number in the first inlet header 2-1 and to the outlet ports 7-1, 3, 5 each having an odd number in the first outlet header 4-1 respectively, and both ends of the heat-exchange coils 8-2, 4 each having an even number are linked to the inlet ports 6-2, 4 each having an even number of the second inlet header 2-2 and to the outlet ports 7-2, 4 of the second outlet header 4-2 respectively.

As the heat-exchange coils 8-1, 2, 3, 4, and 5 are linked to the first and second inlet headers 2-1, 2-2 as well as to the first and second outlet headers 4-1 and 4-2 as described above, a flowing direction of a fluid in the heat-exchange coils 8-1, 2-, 3, 4, 5 is, different from that in each of the first to fourth embodiments, the same as that in the embodiments, but a pitch P between each of the heat-exchange coils 8-1, 2, 3, 4, 5 and each of the heat-exchange coils 8-1, 2, 3, 4, 5 in a linking section between the first and second inlet headers 2-1, 2 and the first and second outlet headers 4-1, 2 is the same as that in the first to fourth embodiments, and an additional space for welding 2*a* is not required to be provided, and the pitch P may be equal to an outer diameter d of each of the heat-exchange coil tubes 8- 1, 8-2, 8-3, 8-4, and 8-5.

Figure 11:
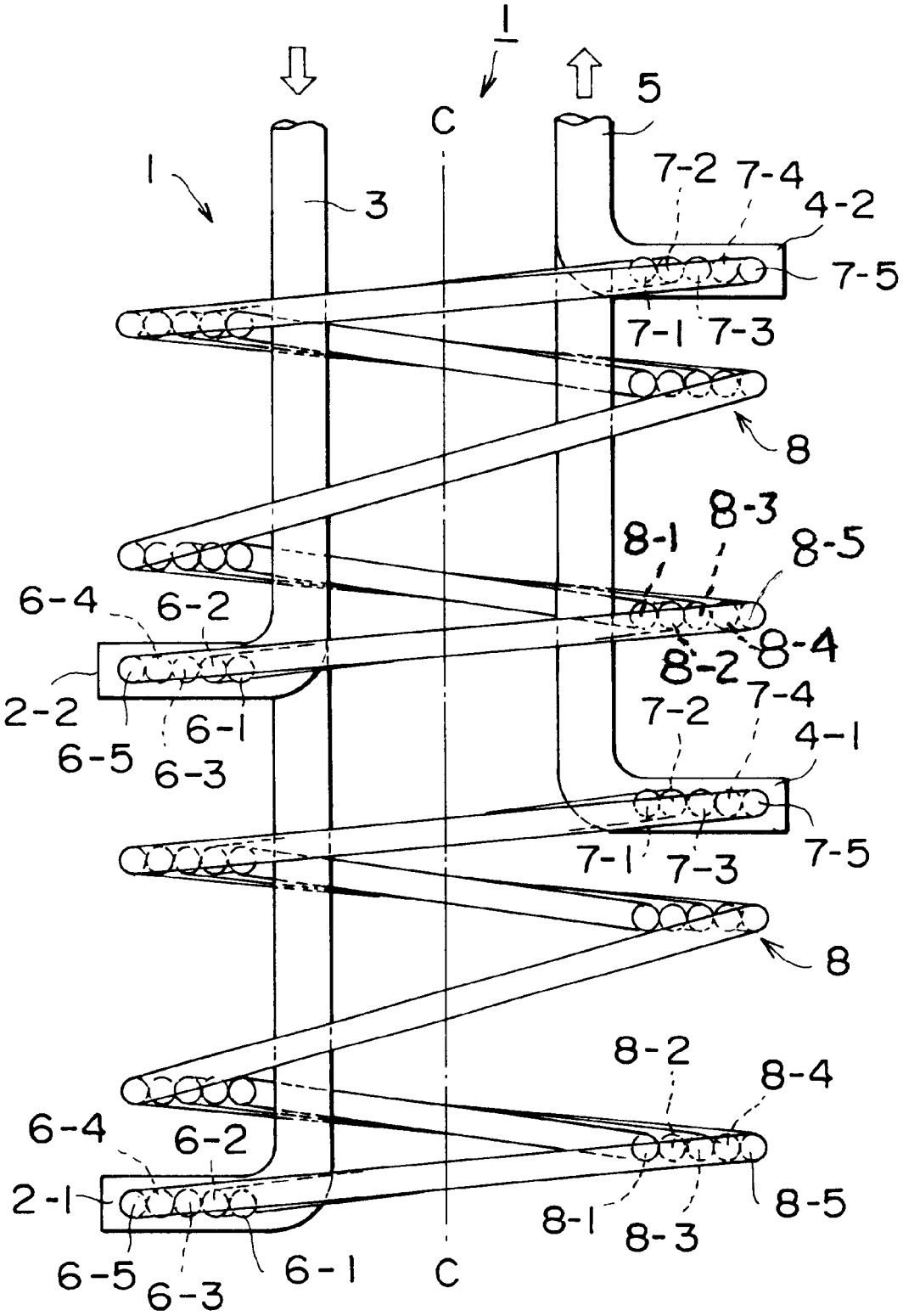
FIG. 11 is a front view showing a seventh embodiment of the present invention.

FIG. 11 shows a seventh embodiment of the present invention, and this embodiment is the same as the sixth embodiment shown in FIG. 9 and FIG. 10 in the point that the first and second inlet headers 2-1, 2 are provided in the inlet tube 3, but is different from the sixth embodiment in the point that the inlet headers 2-1, 2 and outlet headers 4-1, 2 are linked with different heat-exchange coils 8-1,2 respectively, and there is no different point other than that described above, and although there are two pairs of headers 2-1, 2 and headers 4-1, 2 and two heat-exchange coils 8-1, 2, a greater number of pairs may be provided in this embodiment.

Figure 12:
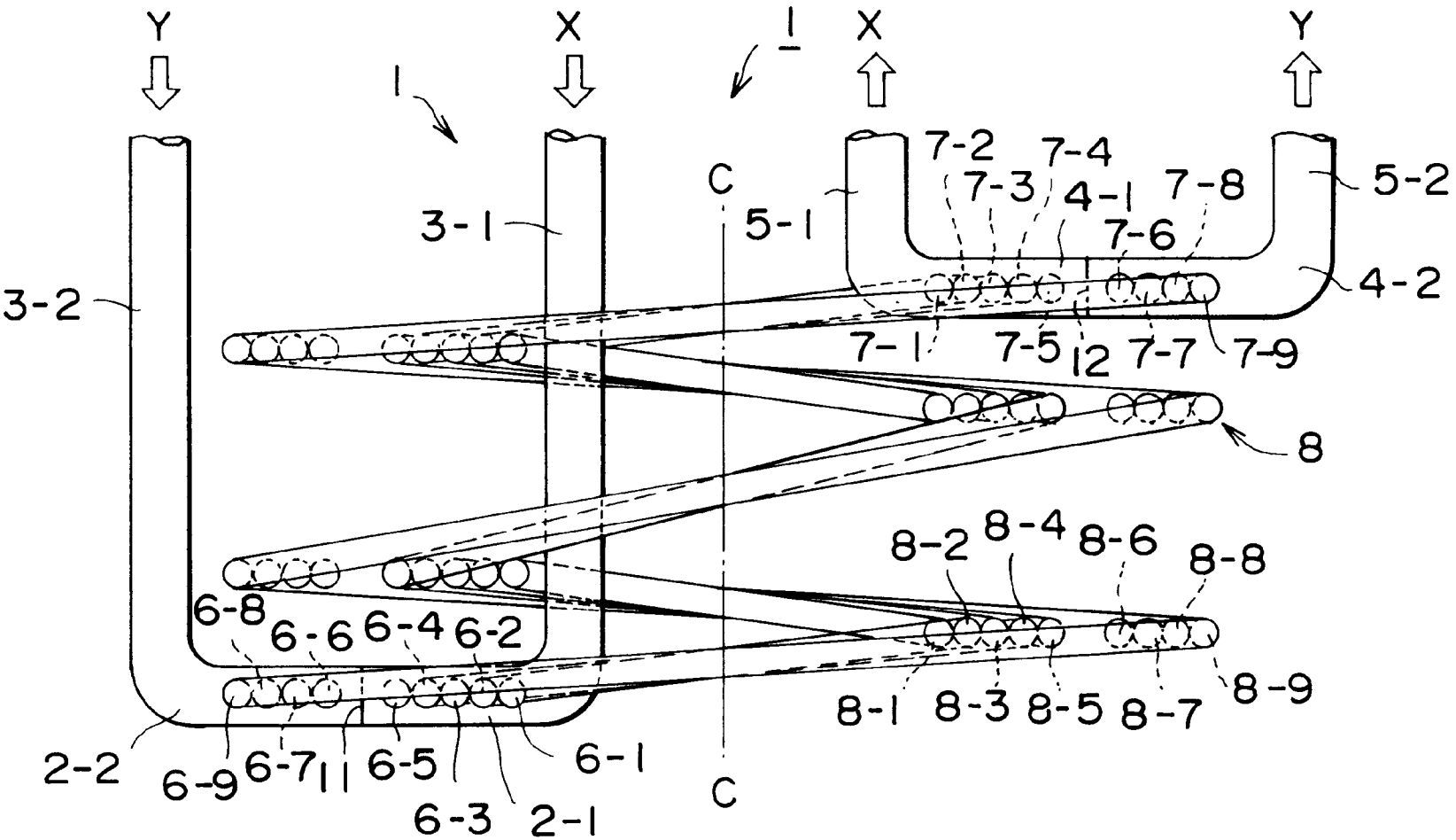
FIG. 12 is a front view showing an eighth embodiment of the present invention.
Figure 13:
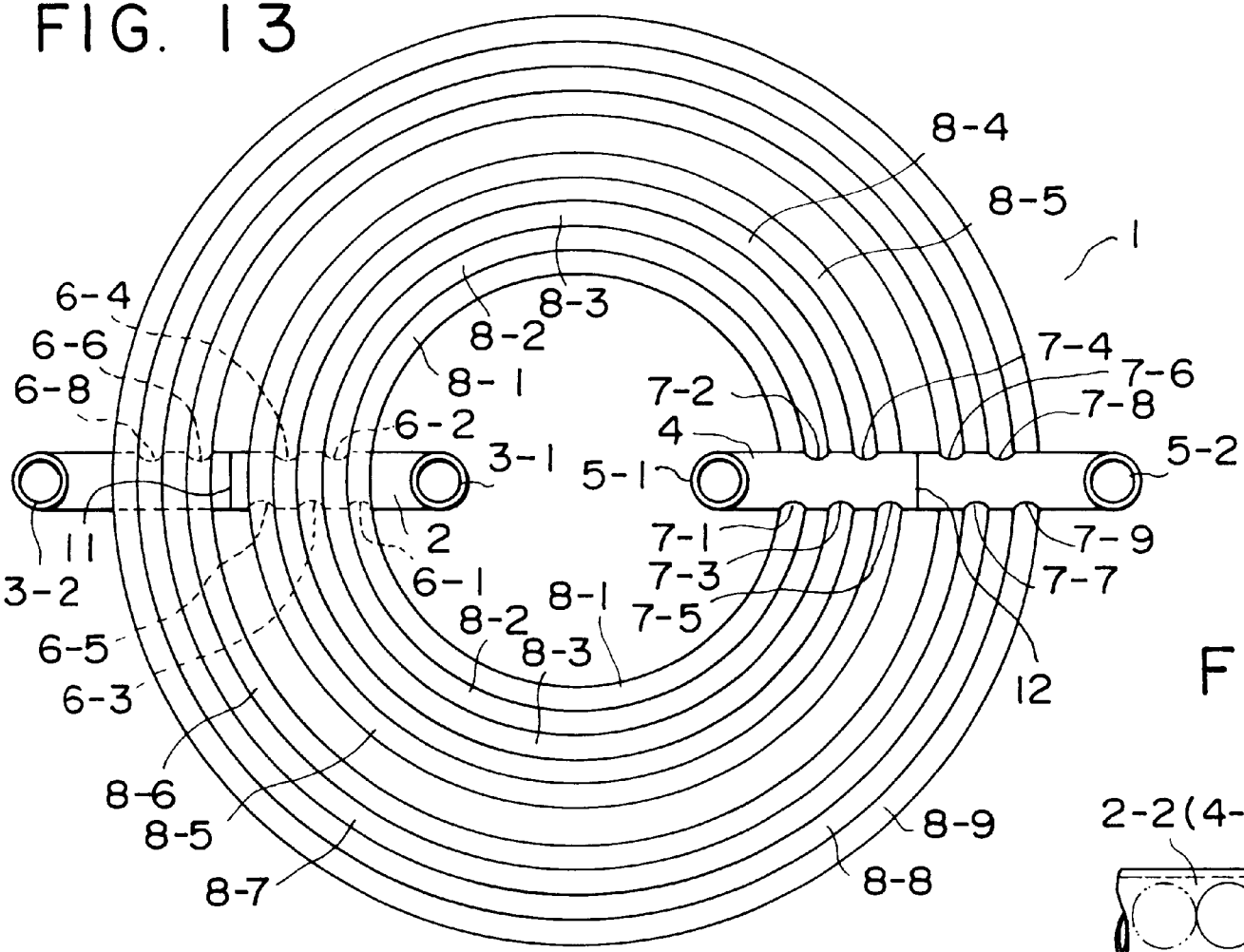
FIG. 13 is a plan view showing the same.
Figure 14:
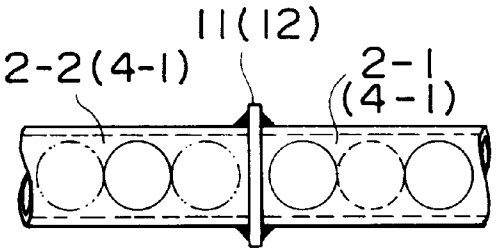
FIG. 14 is a front view showing a linking section of a header of the same.

FIGS. 12, 13, 14 each show an eighth embodiment of the present invention, and in this embodiment, end sections of the first inlet header 2-1 and second inlet header 2-2 and end sections of the first outlet header 4-1 and second outlet header 4-2 in the second embodiment shown in FIG. 4 as well as in the third embodiment shown in FIG. 5 are linked to each other and closed with linking plates 11 and 12, and further the first and second inlet tubes 3-1, 2 and first and second outlet tubes 5-1, 2 are provided therein.

Because of the configuration as described above, the first inlet tube 3-1 and first outlet tube 5-1 are provided outside the second outlet tube 3-2 and second inlet tube 5-2; and the first inlet tube 3-1 and first outlet tube 5-1 handle a fluid for one load system X, while the second inlet tube 3-2 and second inlet tube 5-2 handle a fluid for the other load system Y.

In this embodiment, the heat-exchange coils 8-1, 2, 3, 4, 5 communicated to the load system X and the heat-exchange coils communicated to the load system Y may have either different or identical coil lengths or coil diameters respectively, and the coil length and coil diameter are decided according to the amount of heat required in each of the load systems X and Y.

Figure 15:
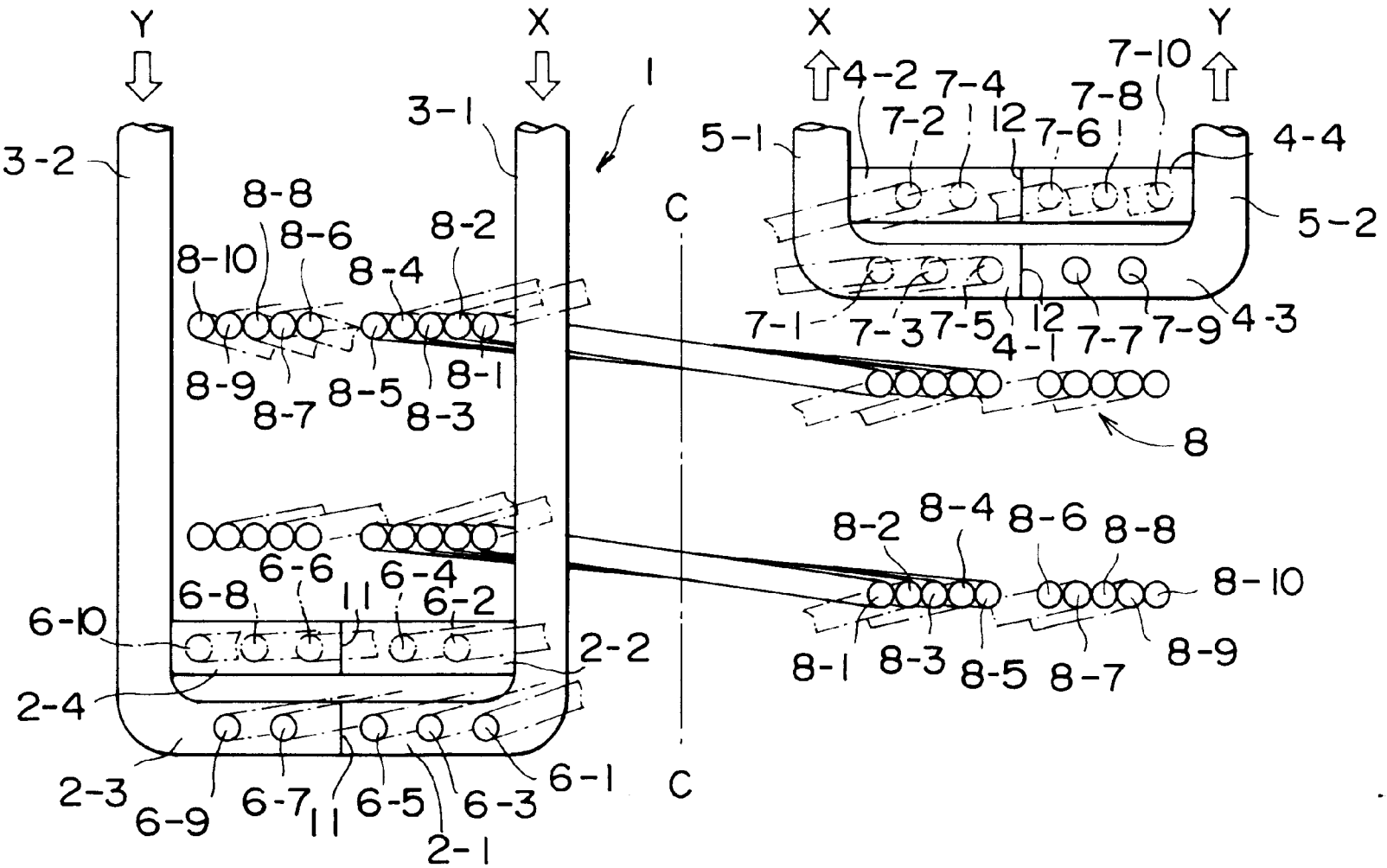
FIG. 15 is a partial cross-sectional view showing a ninth embodiment of the present invention.
Figure 16:
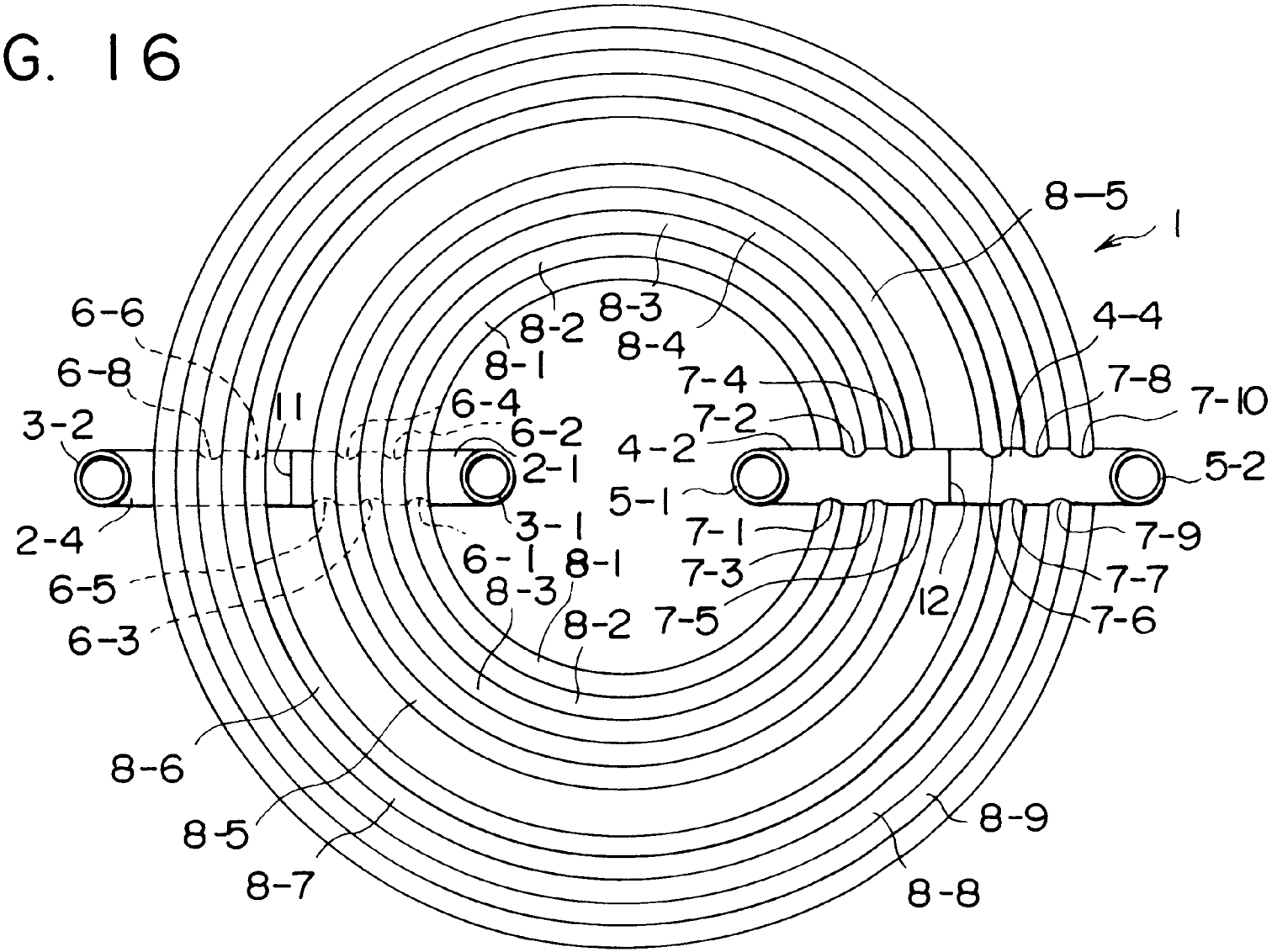
FIG. 16 is a plan view showing the same.

FIG. 15 and FIG. 16 each show a ninth embodiment of the present invention, and in this embodiment, two sets of the heat-exchange coil assembly according to the sixth embodiment shown in FIG. 9 are combined to respond to two load systems X and Y simultaneously. In this embodiment, there are provided the first and second input tubes 3-1, 2 and first and second outlet tubes 5-1, 2, and end sections of the first input headers 2-1, 2 and second inlet headers 2-3, 4 in the first and second inlet tubes 3-1, 2 and end sections of the first outlet headers 4-1, 2 and second outlet headers 4-3, 4 are linked to each other and closed with the linking plates 11, 12 respectively.

Also in this embodiment, like in the eighth embodiment, a coil length and a coil diameter of each of the heat-exchange coils 8-1, 2, 3, 4, and 5 communicated to the load system X may be either equal to or different from those of each of the heat-exchange coils 8-6, 7, 8, and 9, and 10 communicated to the load system Y, and the factors are decided according to the amount of heat required required in the load system X or Y.

Figure 17:
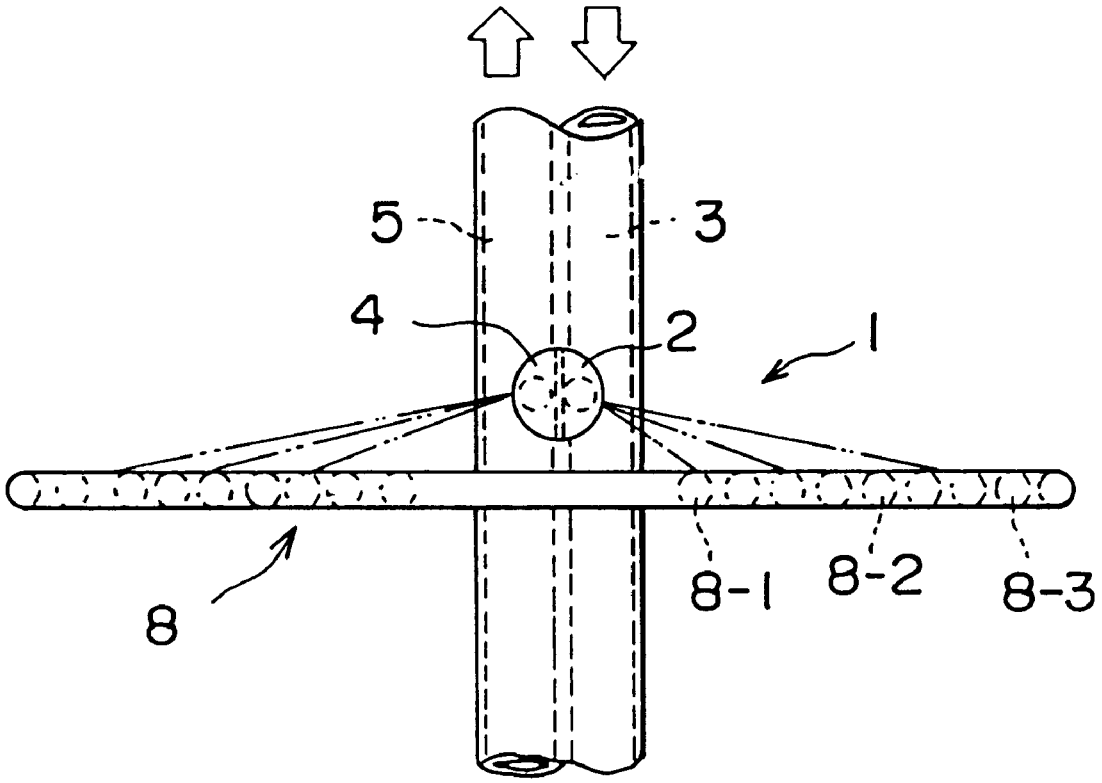
FIG. 17 is a front view showing a tenth embodiment of the present invention.
Figure 18:
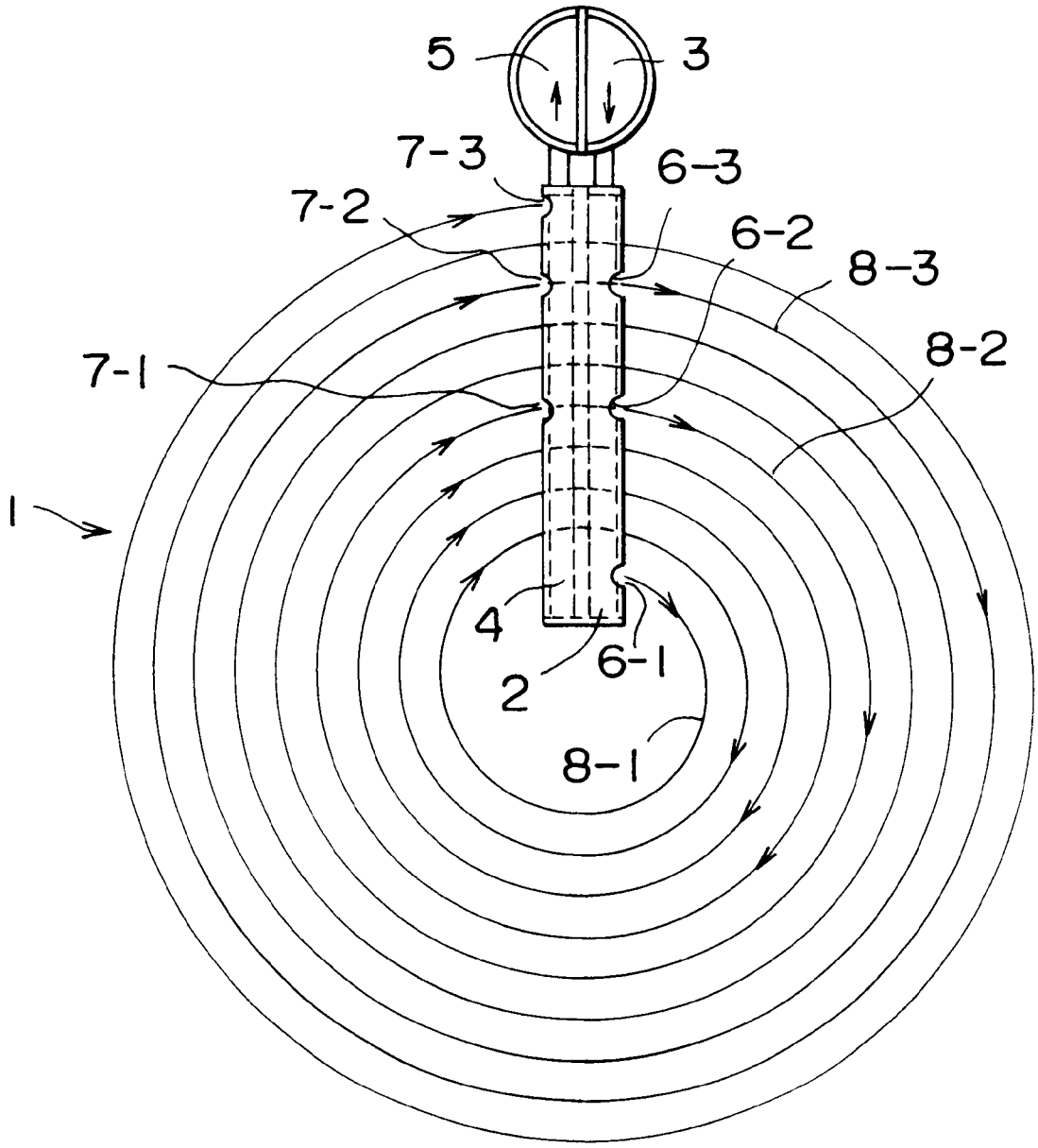
FIG. 18 is a plan diagram showing the same.

FIG. 17 and FIG. 18 each show a tenth embodiment of the present invention, and in this embodiment, like in the first embodiment, the inlet header 2 is provided at a lower edge section of the inlet tube 3 in a posture substantially perpendicular thereto, and also the outlet header 4 is provided at a lower edge section of the outlet tube 5 in a posture substantially perpendicular thereto.

The inlet tube 3 and inlet header 2 and outlet tube 5 and outlet header 4 are adjoining to and provided in parallel to each other, and inlet ports 6-1, 2, 3 are provided in the inlet header 2 and outflow ports 7-1, 2, 3 in the outlet header 4 respectively. And, the inlet ports 6-1, 2, 3 in the inlet-side header 2 and outlet ports 7-1, 2, 3 in the outlet header 4 are linked with the heat-exchange coils 8-1, 2, 3 to each other respectively, and heat exchange between fluids is performed line in other embodiments.

Figure 19:
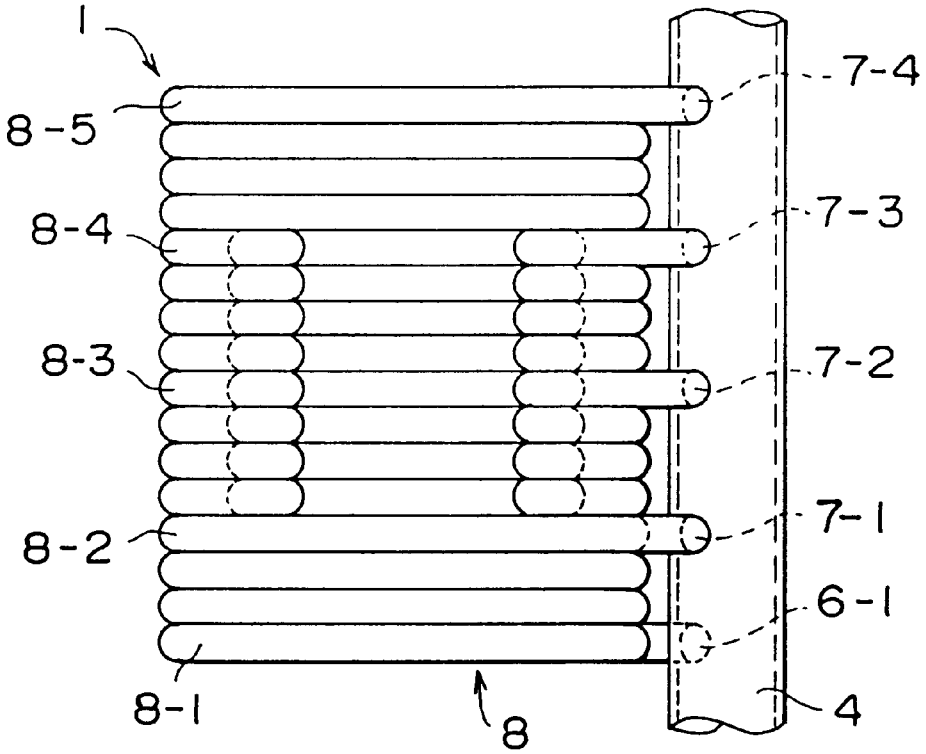
FIG. 19 is a front view showing an eleventh embodiment of the present invention.
Figure 20:
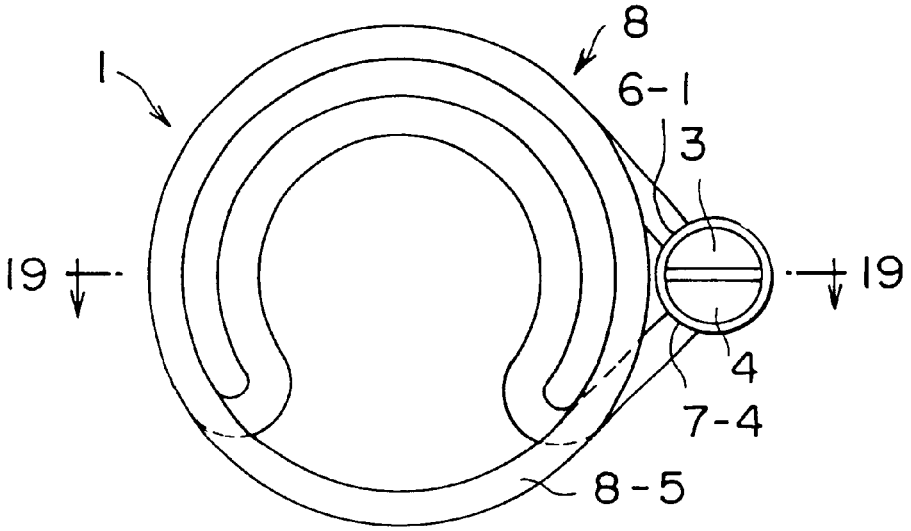
FIG. 20 is a plan view showing the same.

FIG. 19 and FIG. 20 each show an eleventh embodiment of the present invention, and this embodiment is different from the tenth embodiment only in the point that each of the heat-exchange coils 8-1, 2, 3 warps in an intermediate section thereof, and is not different therefrom in other points.

Figure 21:
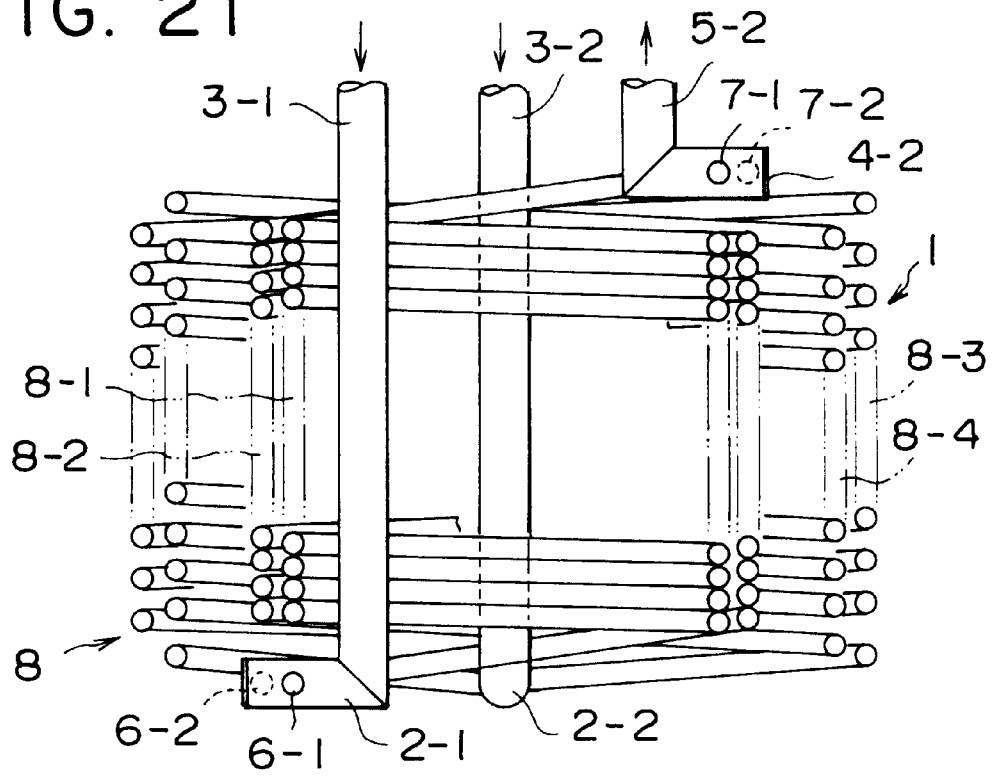
FIG. 21 is a cross-sectional view along the line 21—21 in FIG. 22 showing a twelfth embodiment of the present invention and viewed from a direction indicated by the arrow.
Figure 22:
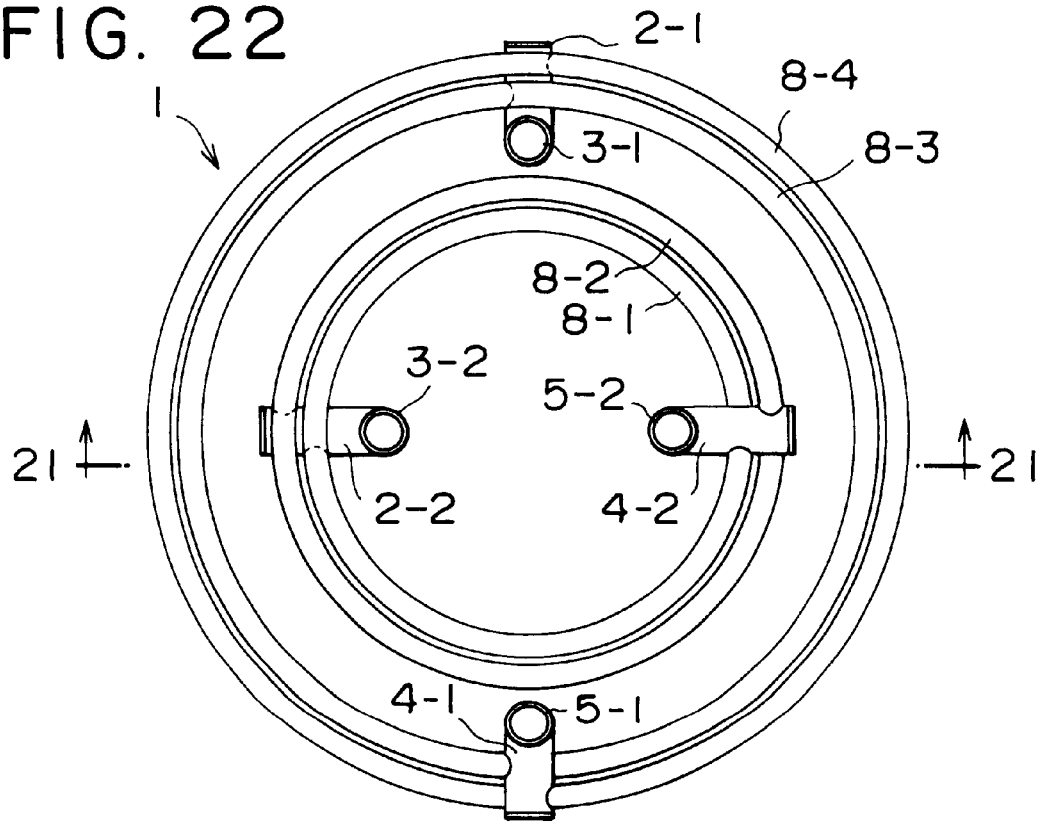
FIG. 22 is a plan view showing the same.
Figure 23:
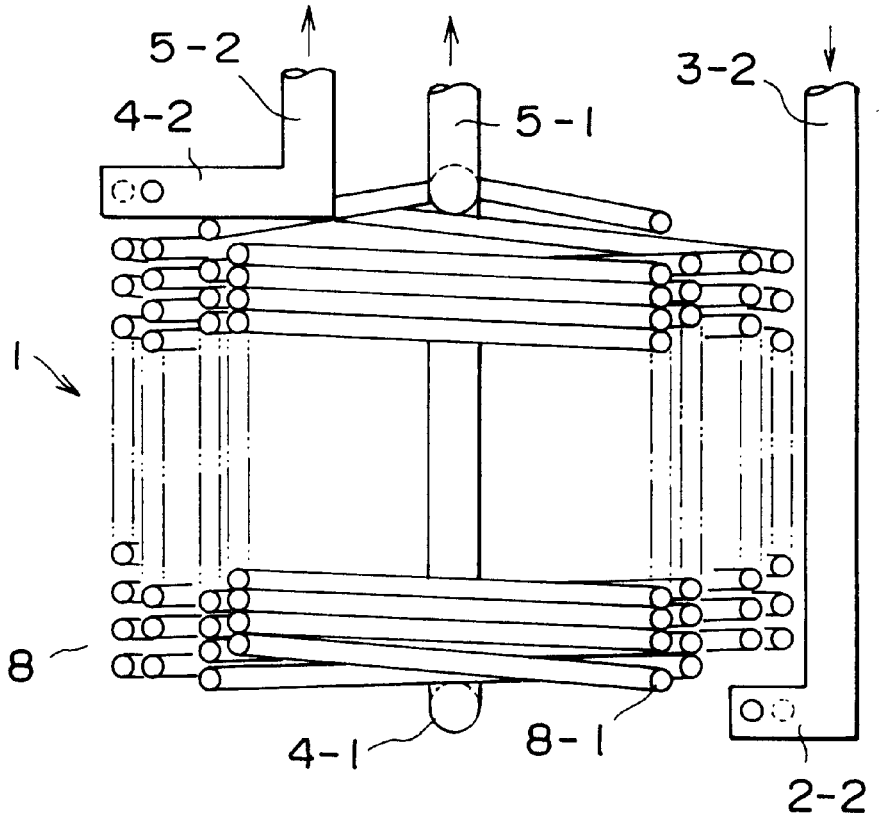
FIG. 23 is a cross-sectional view along the line 23 to 23 in FIG. 24 showing a thirteenth embodiment of the present invention and viewed from a direction indicated by the arrow.
Figure 24:
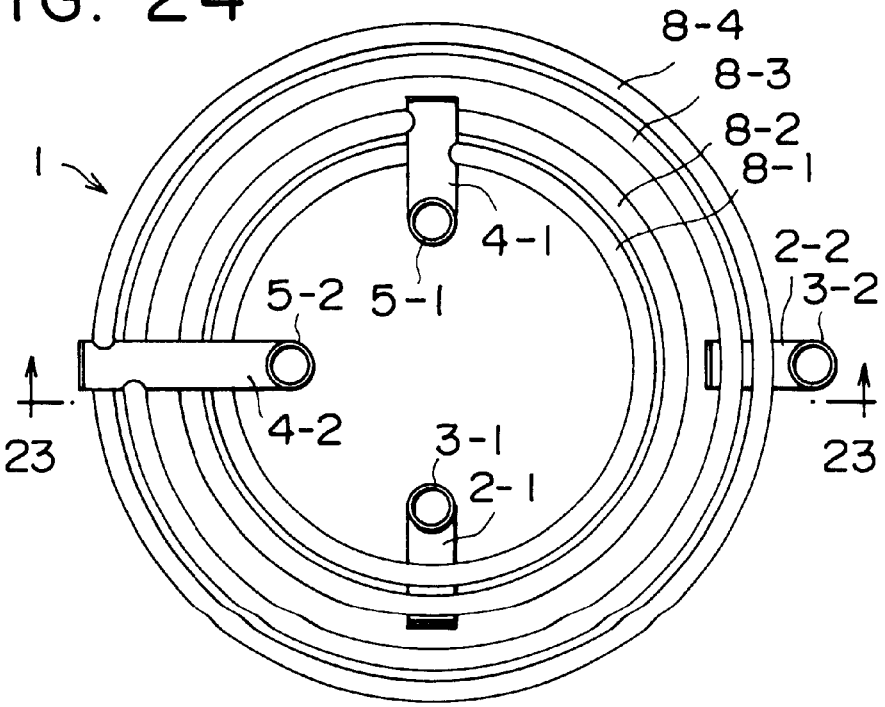
FIG. 24 is a plan view showing the same.

FIG. 21 and FIG. 22 each show a twelfth embodiment of the present invention, while FIG. 23 and FIG. 24 each show thirteenth and fourteenth embodiments of the present invention respectively, and in these embodiments, two sets of the inlet tube 3 and inlet header 2 and two sets of outlet tube 5 and outlet header 4 each in the first embodiment are provided, and further the first and second inlet tubes 3-1, 2, first and second inlet headers 2-1, 2, and the first and second outlet tubes 5-1, 2 and first and second outlet headers 4-1, 2 are provided so that the sets are provided with a space therebetween in the peripheral direction with the heat-exchange coils 8-1, 2 provided in the inner side and heat-exchange coils 8-3, 4 in the outer side, and both edges thereof are linked to the first and second inlet headers 2-1, 2 as well as to the first and second outlet headers 4-1, 2 respectively.

FIG. 25 and FIG. 26 each show a heat exchanger 21 in which the heat-exchange coil assembly 1 according to the present invention is applied, and in this heat exchanger 21, a furnace cylinder 23 is provided under a drum section 22 of this heat exchanger 11, and a furnace chamber 24 is provided therein. A burner (combustor) 25 is installed in the furnace chamber 24, operations of this burner are controlled by a thermostat, a gas in the furnace chamber 24 is heated by a flame generated therein, the heated gas heats water in the drum section 22 via tube walls of the convector tubes 28, 29 to a preset temperature, and then the gas is discharged through a discharge pipe 31 to outside.

The drum section 22 is communicated via a conduit 32 to a water supply tank 33 with a ball tap 34 provided in the water supply tank 33, and water is supplied via a water supply pipe so that a liquid surface of water reserved therein is kept at a constant level. A gas chamber 37 is formed above a liquid surface in the drum section 22, and a gas in this gas chamber 37 is released to atmosphere via a conduit 38, the water supply tank 33, and a release pipe 39. 20 With this construction, the reserved water 27 is heated under a pressure lower than the atmospheric pressure, and also the temperature is kept below the boiling point (100° C.). In this example, the heat-exchange coil assembly 1 is connected to a load system such as a heating system, a hot-water supply unit, a bath, or a swimming pool not shown herein.

The embodiments above were described only for understanding of the present invention, and the present invention is not limited to the embodiments, and various configurations are allowable in which, for instance, outlet tubes and inlet tubes are used in the reverse mode, a heating medium and a heat-receiving medium are used reversely, or a heat exchanger using the heat-exchange coil assembly therein is not of an upright type, but of a horizontal type.

What is claimed is:

1. A heat-exchange coil assembly comprising:

a medium inlet member having at least one inlet tube and at least one inlet header, said at least one inlet header being in a posture substantially perpendicular to that of said at least one inlet tube and having a plurality of outflow ports alternately provided on the peripheral wall thereof on opposite sides of the centerline thereof;

a medium outlet member having at least one outlet tube and at least one outlet header, said at least one outlet header being in a posture substantially perpendicular to that of said at least one outlet tube and having a plurality of inflow ports alternately provided on the peripheral wall thereof on opposite sides of the centerline thereof; and, a plurality of heat-exchange coils, having a common center line and communicating the at least one inlet header to the at least one outlet header;

wherein each coil has a different winding diameter and said coils are alternately linked to the respective headers at alternating opposite sides of the center lines of the headers such that a fluid flowing out from the inlet header through the heat-exchange coils flows in a direction opposite to a flowing direction of a fluid flowing into the outlet header; and wherein said heat-exchange coil assembly is adapted to be accommodated inside a drum containing a heat-exchange medium.

2. The heat-exchange coil assembly according to claim 1 having one inlet tube, one inlet header, one outlet tube and one outlet header;

wherein the inlet header and the outlet header are located on opposite sides of said coil center line.

3. The heat-exchange coil assembly according to claim 1 having one inlet tube, one inlet header, one outlet tube and one outlet header;

wherein the inlet header and the outlet header are located on the same side of said coil center line.

4. A heat-exchange coil assembly according to claim 1 having more than one inlet header and more than one outlet header, each inlet header and outlet header linked to one inlet tube and to one outlet tube respectively.

5. The heat-exchange coil assembly according to claim 1 having a first and a second inlet tube connected to a first and a second inlet header, respectively, and a first and a second outlet tube connected to a first and a second outlet header, respectively;

wherein said inlet headers have tips, said tips being not-communicably joined to each other, and said outlet headers have tips, said tips being not-communicably joined to each other; and wherein some of the heat-exchange coils communicate the first inlet header only to the first outlet header and the remainder of the heat-exchange coils communicate the second inlet header only to the second outlet header.

6. The heat-exchange coil assembly according to claim 5 wherein the heat-exchange coils communicating the first inlet tube and first outlet tube have a different length and diameter from the heat-exchange coils communicating the second inlet tube and second outlet tube.

7. The heat-exchange coil assembly according to claim 1 having:

a first and a second inlet tube connected to a first and a second inlet header, respectively, a first and a second outlet tube connected to a first and a second outlet header, respectively, and, wherein the het-exchange coils are alternately linked to the first and second inlet header and alternately linked to the first and second outlet headers.

8. The heat-exchange coil assembly according to claim 7; wherein said inlet headers have tips, said tips being not-communicably joined to each other, and said outlet headers have tips, said tips being not-communicably joined to each other.

9. A heat-exchange coil assembly comprising:

a medium inlet member having at least one inlet tube and at least one inlet header;

a medium outlet member having at least one outlet tube and at least one outlet header; and, a plurality of heat-exchange coils communicating the at least one inlet header to the at least one outlet header;

wherein each coil has a different winding diameter and said coils are alternately linked to opposite sides of the center lines of the headers and have a common center line; and wherein the medium inlet member and medium outlet member are located adjacent to each other.

10. The heat-exchange coil assembly according to claim 9 wherein the inlet header and outlet header comprise chambers formed in a single tube, said chambers being separated from each other by a partition.

11. The heat-exchange coil assembly according to claim 10 wherein the heat-exchange coils have the same length.

12. The heat-exchange coil assembly according to claim 9 wherein the heat-exchange coils have the same length.

* * * * *